US008243108B2

(12) United States Patent
Chen et al.

(10) Patent No.: US 8,243,108 B2
(45) Date of Patent: Aug. 14, 2012

(54) PIXEL CIRCUIT AND DRIVING METHOD THEREOF

(75) Inventors: Pei-Yi Chen, Hsin-Chu (TW); Hsueh-Ying Huang, Hsin-Chu (TW); Chih-Yuan Chien, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 391 days.

(21) Appl. No.: 12/507,802

(22) Filed: Jul. 23, 2009

(65) Prior Publication Data

US 2010/0110319 A1 May 6, 2010

(30) Foreign Application Priority Data

Nov. 6, 2008 (TW) ..... 97142841 A

(51) Int. Cl.
*G09G 5/02* (2006.01)

(52) U.S. Cl. ..... 345/694; 345/92; 345/99; 345/204

(58) Field of Classification Search ..... 345/55, 345/60, 76, 82, 84, 87, 690, 694, 89, 92, 345/99, 100, 103, 204
See application file for complete search history.

(56) References Cited

U.S. PATENT DOCUMENTS 6,486,930 B1 * 11/2002 Kwon ..... 349/48
6,982,690 B2 * 1/2006 Lee et al. ..... 345/87
6,999,053 B2 * 2/2006 Lee et al. ..... 345/92
7,142,179 B2 * 11/2006 Miller et al. ..... 345/76
7,199,808 B2 * 4/2007 Yo ..... 345/694
7,719,623 B2 * 5/2010 Hsieh et al. ..... 349/39
7,847,773 B2 * 12/2010 Chiang et al. ..... 345/93
7,852,302 B2 * 12/2010 Chiang et al. ..... 345/93
7,907,131 B2 * 3/2011 Su et al. ..... 345/204
7,936,344 B2 * 5/2011 Shih ..... 345/204
8,018,401 B2 * 9/2011 Shin ..... 345/76
2008/0036786 A1 2/2008 Tajiri
2010/0118058 A1 * 5/2010 Murai et al. ..... 345/690

FOREIGN PATENT DOCUMENTS

TW 548615 8/2003
TW 200735025 9/2007

* cited by examiner

*Primary Examiner* — Lun-Yi Lao
*Assistant Examiner* — Tom Sheng
(74) *Attorney, Agent, or Firm* — Winston Hsu; Scott Margo

(57) ABSTRACT

Pixel circuit includes first and second scan lines, data line, three switches, and pixel. Three switches all include first end, second end, and control end. Pixel includes first and second sub-pixels. First end of first switch is coupled to data line. Control end of first switch is coupled to first scan line. First end of second switch is coupled to second end of first switch. Control end of second switch is coupled to second scan line. First end of third switch is coupled to data line. Control end of third switch is coupled to first scan line. First sub-pixel is coupled to second end of second switch for coupling to second end of third switch through second and first switches. Second sub-pixel is coupled to second end of third switch for coupling to data line through third switch.

8 Claims, 5 Drawing Sheets

PIXEL CIRCUIT AND DRIVING METHOD THEREOF

BACKGROUND OF THE INVENTION

1. Field of the Invention

The present invention relates to a pixel circuit and driving method thereof, and more particularly, to a pixel circuit and driving method thereof capable of improving the color washout phenomenon.

2. Description of the Prior Art

Since the Liquid Crystal Display (LCD) has the advantage of the smaller size, the lower power consumption and no radiance, the LCD is becoming the main stream of the market gradually. However, the desire of the LCD with the wider viewing angle, the higher resolution and the larger size is the market trend.

However, when watching the LCD from a large viewing angle, the color washout phenomenon is generated so that the color of the image is distorted. The so-called color washout phenomenon means that when watching the LCD from a larger viewing angle, the color of the image is distorted to be whiter than normal. That is, when watching the LCD from a larger viewing angle, the distortion for the pixels with the medium and low gray-level luminance is more serious. As a result, reducing the redundant luminance can effectively improve the color washout phenomenon. Therefore, because of the trend of the image without distortion, the development of the wide viewing angle technology is necessary.

SUMMARY OF THE INVENTION

The present invention provides a pixel circuit. The pixel circuit comprises a first scan line, a second line, a data line, a first pixel switch, a second pixel switch, a third pixel switch, and a pixel. The first pixel switch comprises a first end, coupled to the data line, a second end, and a control end, coupled to the second scan line. The second pixel switch comprises a first end, coupled to the second end of the first pixel switch, a second end, and a control end, coupled to the first scan line. The third pixel switch comprises a first end, coupled to the data line, a second end, and a control end, coupled to the first scan line. The pixel comprises a first sub-pixel and a second sub-pixel. The first sub-pixel is coupled to the second end of the second pixel switch for coupling to the data line through the first pixel switch and the second pixel switch. The second sub-pixel is coupled to the second end of the third pixel switch for coupling to the data line through the third pixel switch.

The present invention further provides a pixel circuit. The pixel circuit comprises a first scan line, a second scan line, a data line, a first pixel switch, a second pixel switch, a third pixel switch, and a pixel. The first pixel switch comprises a first end, a second end, and a control end, coupled to the second scan line. The second pixel switch comprises a first end, coupled to the second end of the first pixel switch, a second end, coupled to the data line, and a control end, coupled to the first scan line. The third pixel switch comprises a first end, coupled to the data line, a second end, and a control end, coupled to the first scan line. The pixel comprises a first sub-pixel and a second sub-pixel. The first sub-pixel is coupled to the first end of the first pixel switch for coupling to the data line through the second pixel switch and the first pixel switch. The second sub-pixel is coupled to the second end of the third pixel switch for coupling to the data line through the third pixel switch.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
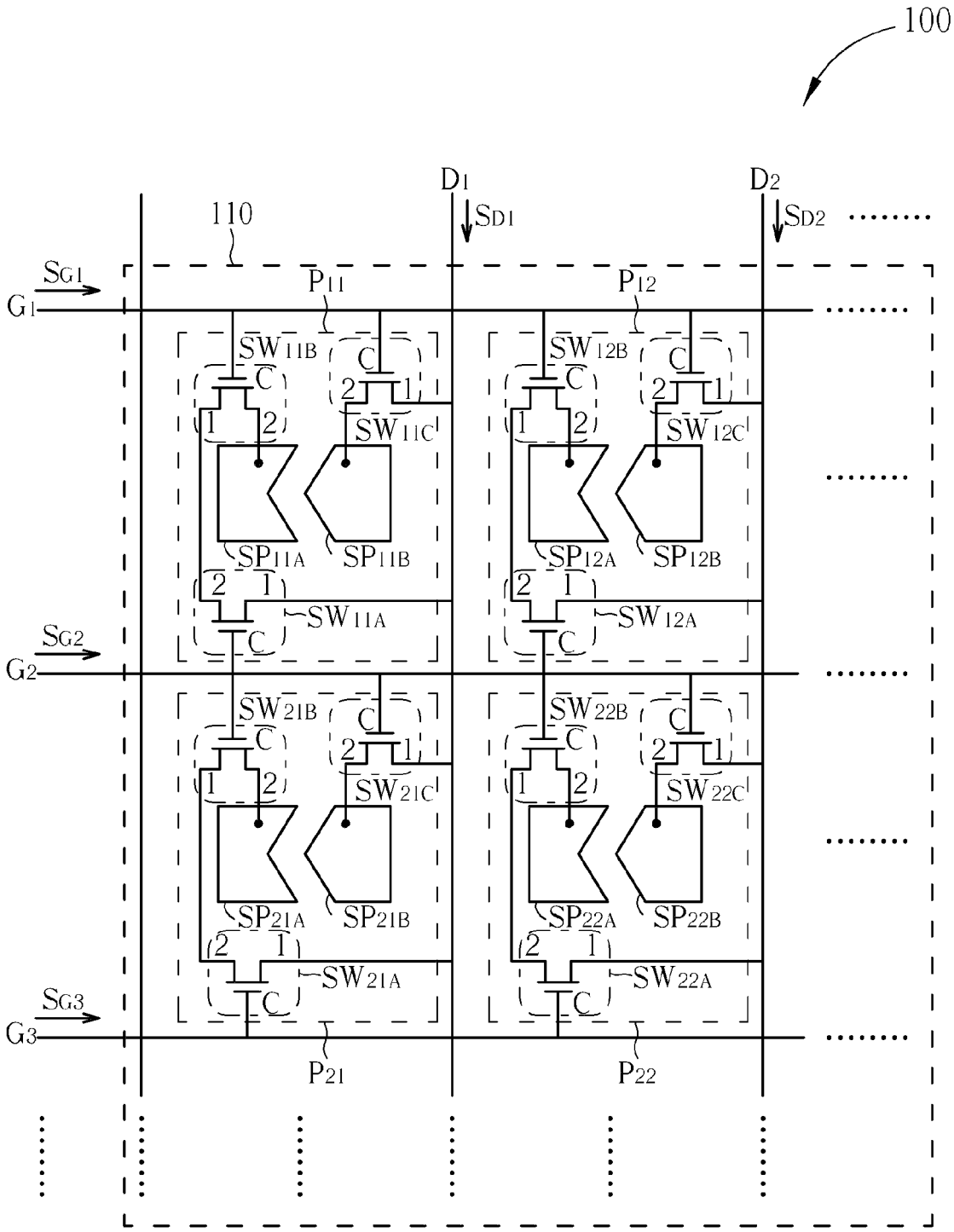
FIG. 1 is a diagram illustrating the LCD according to a first embodiment of the present invention.

Please refer to FIG. 1. FIG. 1 is a diagram illustrating the LCD 100 according to a first embodiment of the present invention. The LCD 100 comprises a plurality of data lines, for example, $D_1$, and $D_2$, and a plurality of scan lines, for example, $G_1$, $G_2$ and $G_3$. The scan lines $G_1$, $G_2$, $G_3$ and so on are orientated to a first direction (the horizontal direction) and are approximately arranged in parallel with each other. The data lines $D_1$, $D_2$, and so on are orientated to a second direction (vertical direction) and are approximately arranged in parallel with each other.

The LCD 100 is divided into a plurality of display areas by the scan lines $G_1$, $G_2$, $G_3$ and so on, and the data lines $D_1$, $D_2$, $D_3$ and so on. The display areas are arranged in an array. In each display area, a pixel P is disposed, for example, the pixels $P_{11}$, $P_{12}$, $P_{21}$ and $P_{22}$. In this way, a pixel array (pixel circuit) 110 is formed on the LCD 100. In one preferred embodiment, each pixel is divided into at least a first sub-pixel and a second sub-pixel. For example, the pixel $P_{11}$ is divided into a first sub-pixel $SP_{11A}$ and a second sub-pixel $SP_{11B}$. In the present embodiment, the first sub-pixels of the pixels of the $M^{th}$ row in the horizontal direction are all coupled to the $M^{th}$ scan line $G_M$ and the $(M+1)^{th}$ scan line $G_{M+1}$, and the second sub-pixels of the $M^{th}$ row in the horizontal direction are all coupled to the $M^{th}$ scan line $G_M$. In addition, the first sub-pixel and the second sub-pixel of the pixels of the $N^{th}$ column in the vertical direction receive the data signal $S_D$ transmitted from the data line $D_N$, wherein both M and N are positive integers.

Each pixel comprises a first sub-pixel, a second sub-pixel, a first pixel switch, a second pixel switch and a third pixel switch. The first sub-pixel is coupled through the first and the second pixel switches to the corresponding scan lines and the corresponding data line. The second sub-pixel is coupled through the third pixel switch to the corresponding scan line and the corresponding data line. For instance, the pixel $P_{11}$ comprises a first sub-pixel $SP_{11A}$, a second sub-pixel $SP_{11B}$, a first pixel switch $SW_{11A}$, a second pixel switch $SW_{11B}$ and a third pixel switch $SW_{11C}$. Each pixel switch comprises a first end, a second end and a control end. Each pixel switch, according to the voltage level of the control end of the pixel switch, couples the first end of the pixel switch to the second end of the pixel switch. More precisely, when the voltage on the control end of a pixel is at a high voltage level, the pixel switch is turned on. That is, the first end 1 of the pixel switch is coupled to the second end 2 of the pixel switch. In the pixel $P_{11}$, the control end C of the first pixel switch $SW_{11A}$ is coupled to the scan line $G_2$ for receiving the scan signal $S_{G2}$, the first end 1 of the first pixel switch $SW_{11A}$ is coupled to the data line $D_1$, and the second end 2 of the first pixel switch $SW_{11A}$ is coupled to the first end 1 of the second pixel switch $SW_{11B}$; the control end C of the second pixel switch $SW_{11B}$ is coupled to the scan line $G_1$ for receiving the scan signal $S_{G1}$, the first end 1 of the second pixel switch $SW_{11B}$ is coupled to the second end 2 of the first pixel switch $SW_{11A}$, and the second end 2 of the second pixel switch $SW_{11B}$ is coupled to the first sub-pixel $SP_{11A}$; the control end C of the third pixel switch $SW_{11C}$ is coupled to the scan line $G_1$ for receiving the scan signal $S_{G1}$, the first end 1 of the third pixel switch $SW_{11C}$ is coupled to the data line $D_1$, and the second end 2 of the third pixel switch $SW_{11C}$ is coupled to the second sub-pixel $SP_{11B}$. By means of this design, when the LCD 100 displays the image, the first sub-pixel $SP_{11A}$ and the second sub-pixel $SP_{11B}$ of the pixel $P_{11}$ have the luminance with different gray level so as to solve the problem related to the color washout phenomenon. The related operational principle is described in detail hereinafter. The structures of the rest pixels are similar to the pixel $P_{11}$ and hereinafter will not be repeated again for brevity.

Figure 2:
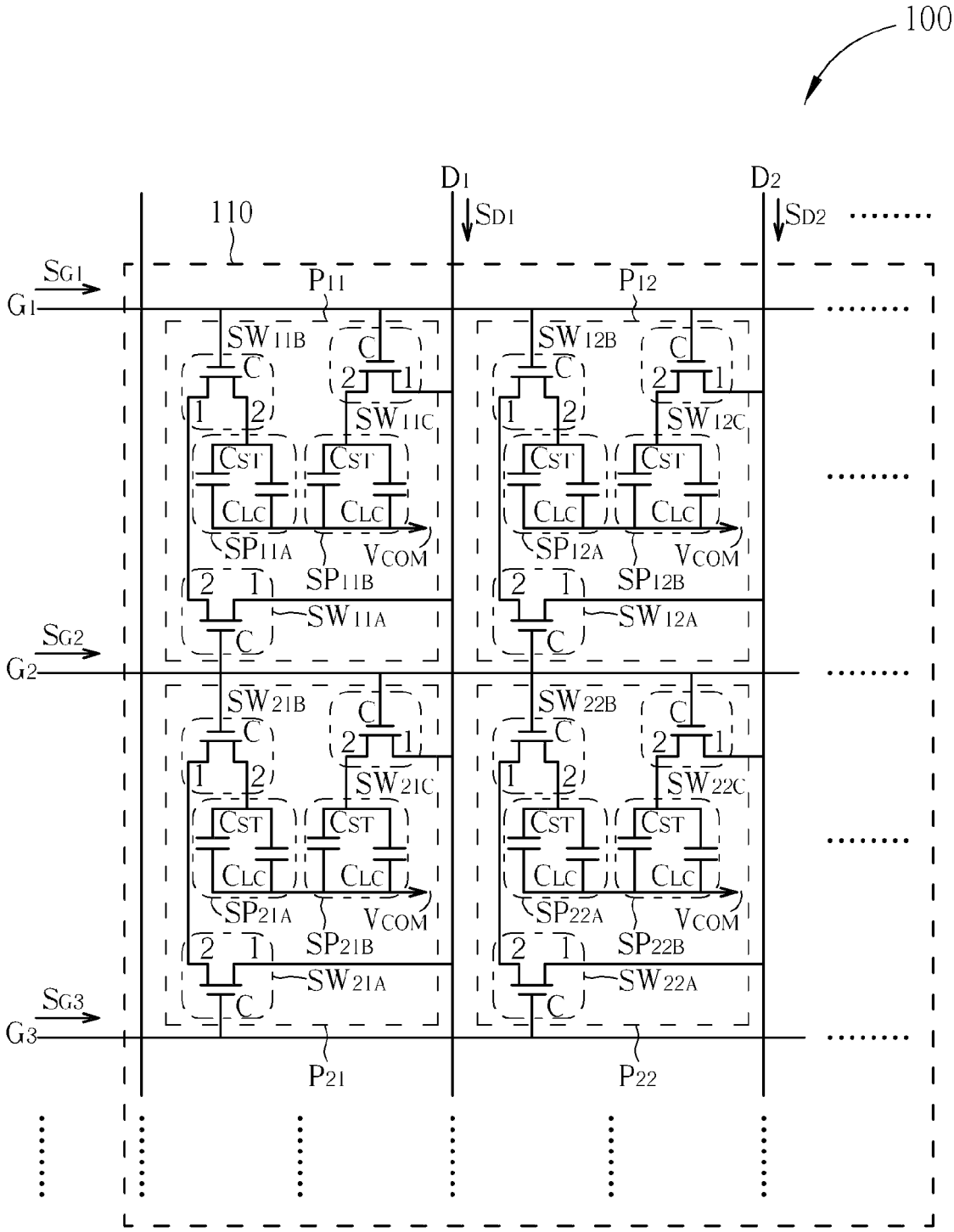
FIG. 2 is a diagram illustrating the equivalent circuit of the LCD according to the first embodiment of the present invention.

Please refer to FIG. 2. FIG. 2 is a diagram illustrating the equivalent circuit of the LCD according to the first embodiment of the present invention. As shown in FIG. 2, each sub-pixel comprises a liquid crystal capacitor and a storage capacitor. For instance, in the pixel $P_{11}$, the first sub-pixel $SP_{11A}$ comprises a liquid crystal capacitor $C_{LC}$ and a storage capacitor $C_{ST}$. The capacitors $C_{LC}$ and $C_{ST}$ are connected in parallel with each other between the second end 2 of the pixel switch $SW_{11B}$ and a common end $V_{COM}$. The common end $V_{COM}$ is utilized for providing a common voltage $V_{COM}$. The second sub-pixel $SP_{11B}$ comprises a liquid crystal capacitor $C_{LC}$ and a storage capacitor $C_{ST}$. The capacitors $C_{LC}$ and $C_{ST}$ are connected in parallel with each other between the second end 2 of the pixel switch $SW_{11C}$ and a common end $V_{COM}$. The structures of the rest pixels are similar to the pixel $P_{11}$ and hereinafter will not be repeated again for brevity.

Figure 3:
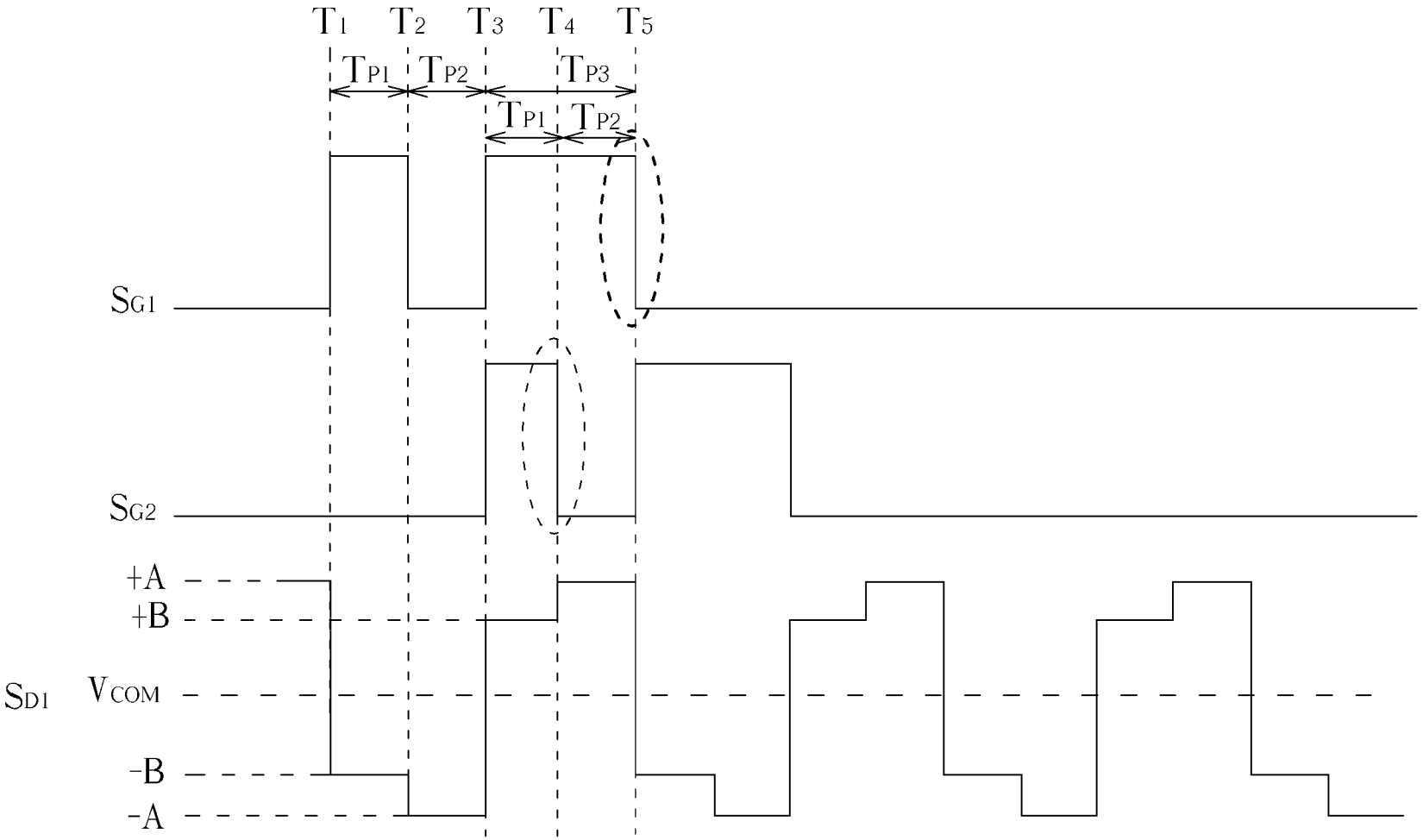
FIG. 3 is a diagram illustrating the driving principle of the LCD.

Pleas refer to FIG. 3. FIG. 3 is a timing diagram illustrating the principle for driving the LCD 100. In FIG. 3, only the pixel $P_{11}$ is illustrated as an example and the driving method of the rest pixels is similar to the pixel $P_{11}$. In the LCD 100, when a pixel is driven, the corresponding scan signal (means the voltage on the corresponding scan line) is raised up to a high voltage level and keeps for a predetermined period $T_{P1}$, and then the corresponding scan signal is lowered down to a low voltage level and keeps for a predetermined period $T_{P2}$. Then the corresponding scan signal is raised up again to the high voltage level and keeps for a predetermined period $T_{P3}$. The length of the predetermined period $T_{P3}$ is the sum of the predetermined periods $T_{P1}$ and $T_{P2}$. As shown in FIG. 3, at the moment $T_3$, the scan signal $S_{G1}$ is raised up to the high voltage level and keeps for the predetermined period $T_{P3}$ (means to keep until the moment $T_5$) and the scan signal $S_{G2}$ is raised up to the high voltage level and keeps for a predetermined period $T_{P1}$ (means to keep until the moment $T_4$). In this way, between the moment $T_3$ and the moment $T_4$, The pixel switches $SW_{11A}$, $SW_{11B}$, $SW_{11C}$, $SW_{21A}$ and the $SW_{21B}$ are all turned on so that the data signal $S_{D1}$ transmits the data +B through the data line $D_1$, the pixel switch $_{SW11A}$ and the pixel switch $SW_{11B}$ to the first sub-pixel $SP_{11A}$ and through the data line $D_1$ and the pixel switch $SW_{11C}$ to the second sub-pixel $SP_{11B}$. Between the moment $T_4$ and the moment $T_5$, the scan signal $S_{G1}$ still keeps at a high voltage level, but the scan signal $S_{G2}$ is lowered down to a low voltage level so that the pixel switch $SW_{11A}$ is turned off and the pixel switches $SW_{11B}$ and $SW_{11C}$ still keep turned on. Since the pixel switch $SW_{11A}$ is turned off, the data signal $S_{D1}$ can not transmit the data +A to the first sub-pixel $SP_{11A}$ (even though the pixel switch $SW_{11B}$ is still turned on). The data signal $S_{D1}$ still transmits the data +A through the data line $D_1$ and the pixel switch $SW_{11C}$ to the second sub-pixel $SP_{11B}$. That is, the data stored in the second sub-pixel $SW_{11B}$ is updated to be the data +A. In other words, both the pixel switches $SW_{11A}$ and $SW_{11B}$ have to be turned on for coupling the first sub-pixel $SP_{11A}$ to the data line $D_1$ so as to receive the data signal $S_{D1}$, but only the pixel switch $SW_{11C}$ has to be turned on for coupling the second sub-pixel $SP_{11B}$ to the data line $D_1$ so as to receive the data signal $S_{D1}$. In this way, the second sub-pixel $SP_{11B}$ is charged up to the voltage level of the data +B first and is then further raised up to the voltage level of the data +A so that the second sub-pixel $SP_{11B}$ can be more precisely charged up to the voltage level of the data +A. In this way, after driving by the scan signals $S_{G1}$ and $S_{G2}$, the first sub-pixel $SP_{11A}$ and the second sub-pixel $SP_{11B}$ have different data (means to have different gray levels and different luminance) so as to reduce the color washout phenomenon.

Figure 4:
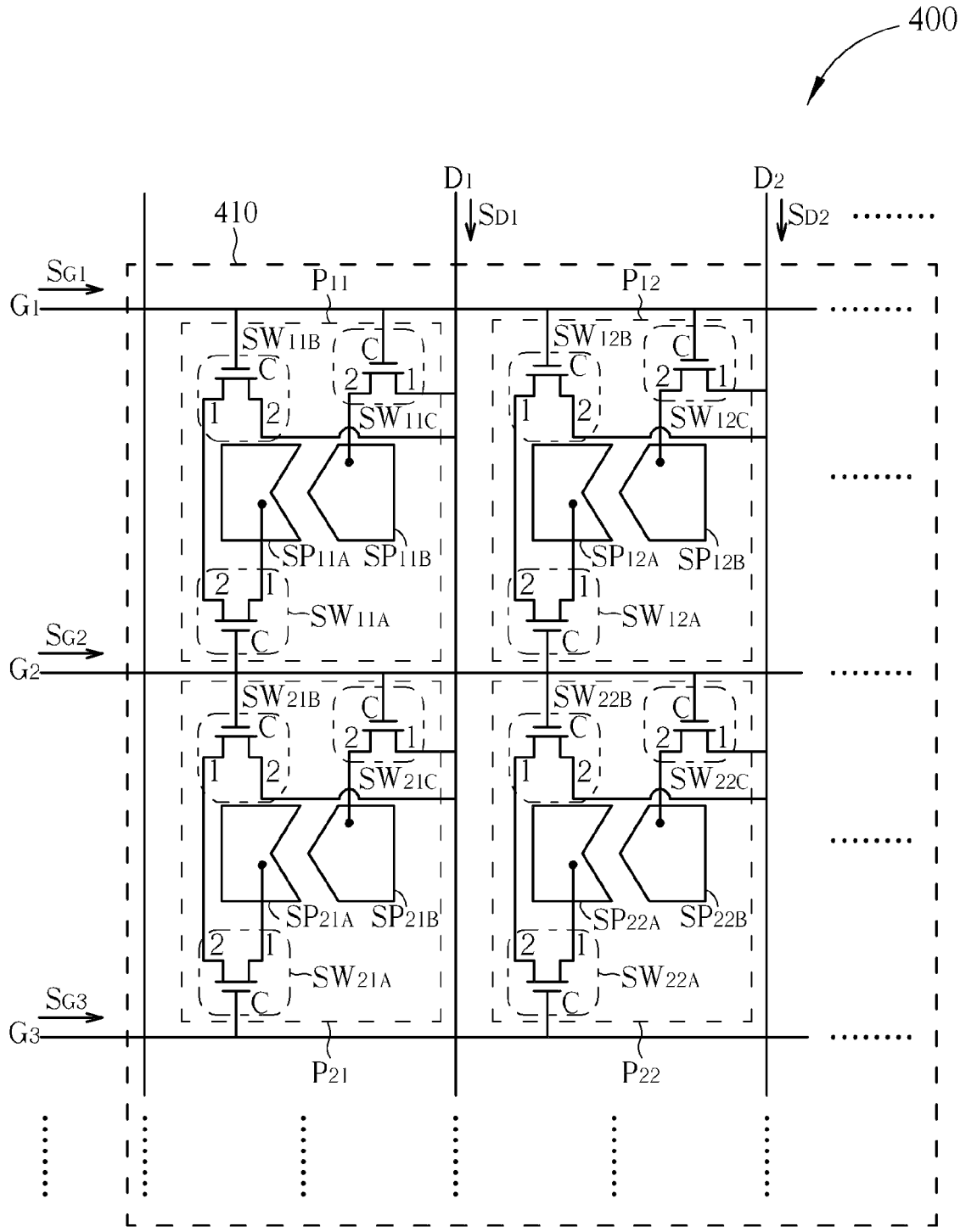
FIG. 4 is a diagram illustrating the LCD according to a second embodiment of the present invention.

Please refer to FIG. 4. FIG. 4 is a diagram illustrating the LCD 400 according to a second embodiment of the present invention. The LCD 400 is similar to the LCD 100. The difference between the LCDs 100 and 400 is that the coupling relation between the pixel switches of the pixels of the pixel array 410 is different from that between the pixel switches of the pixels of the pixel array 110. The detailed coupling relation is described hereinafter.

For instance, in the pixel array 410, the pixel $P_{11}$ comprises a first sub-pixel $SP_{11A}$, a second sub-pixel $SP_{11B}$, a first pixel switch $SW_{11A}$, a second pixel switch $SW_{11B}$ and a third pixel switch $SW_{11C}$. In the pixel $P_{11}$, the control end C of the first pixel switch $SW_{11A}$ is coupled to the scan line $G_2$ for receiving the scan signal $S_{G2}$; the first end 1 of the first pixel switch $SW_{11A}$ is coupled to the first sub-pixel $SP_{11A}$; the second end 2 of the first pixel switch $SW_{11A}$ is coupled to the first end 1 of the second pixel switch $SW_{11B}$. The control end C of the second pixel switch $SW_{11B}$ is coupled to the scan line $G_1$ for receiving the scan signal $S_{G1}$; the first end 1 of the second pixel switch $SW_{11B}$ is coupled to the second end 2 of the first pixel switch $SW_{11A}$; the second end 2 of the second pixel switch $SW_{11B}$ is coupled to the data line $D_1$. The control end C of the third pixel switch $SW_{11C}$ is coupled to the scan line $G_1$ for receiving the scan signal $S_{G1}$; the first end 1 of the third pixel switch $SW_{11C}$ is coupled to the data line $D_1$; the second end 2 is coupled to the second sub-pixel $SP_{11B}$. By means of such design, when the LCD 400 displays the image, the first sub-pixel $SP_{11A}$ and second sub-pixel $SP_{11B}$ have the luminance with different gray level so as to solve the problem related to the color washout phenomenon. The related operational principle is described in detail hereinbefore. The structures of the rest pixels are similar to the pixel $P_{11}$ and hereinafter will not be repeated again for brevity.

Figure 5:
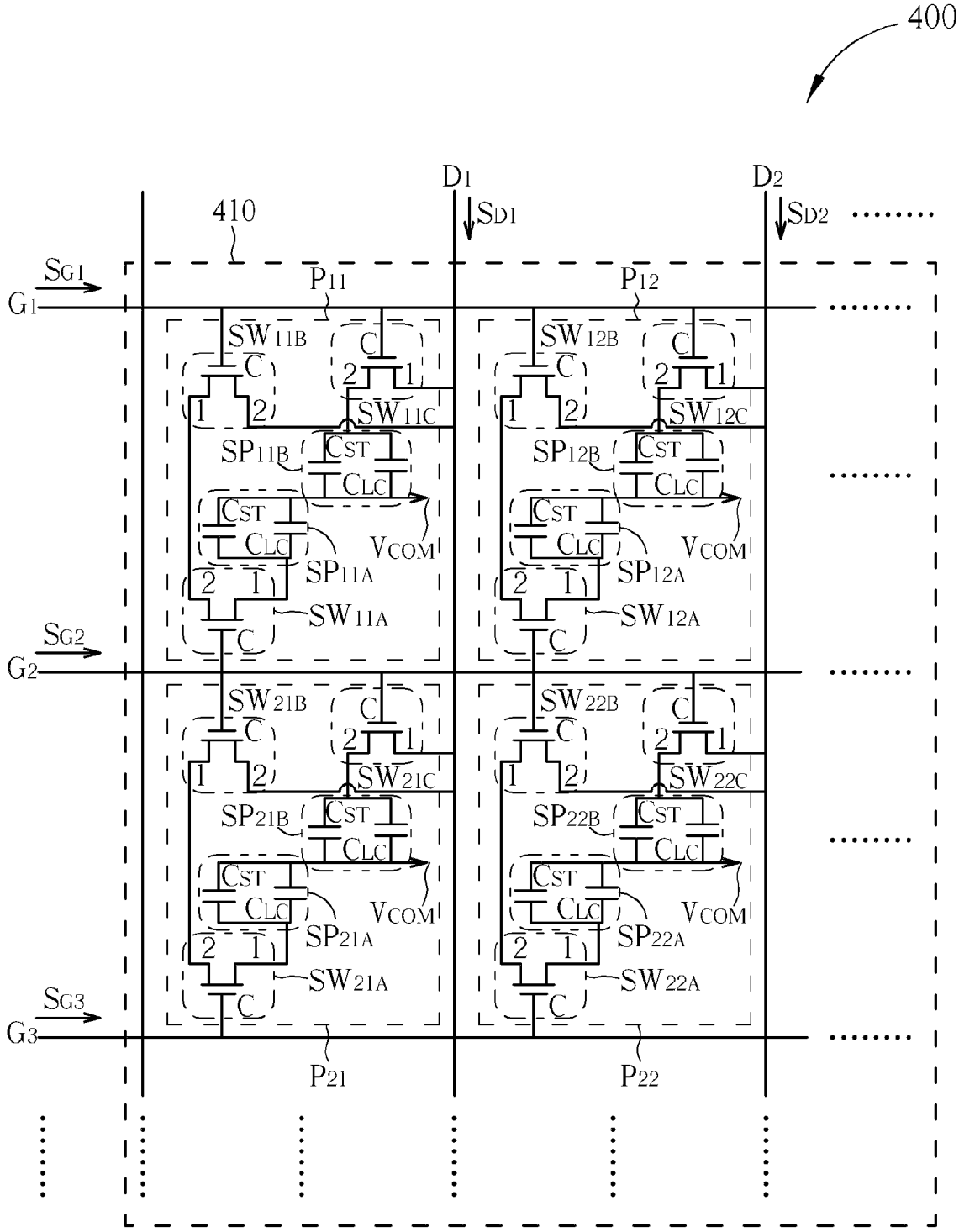
FIG. 5 is a diagram illustrating the equivalent circuit of the LCD according to the second embodiment of the present invention.

Please refer to FIG. 5. FIG. 5 is a diagram illustrating the equivalent circuit of the LCD 400 according to the second embodiment of the present invention. As shown in FIG. 5, each sub-pixel comprises a liquid crystal capacitor and a storage capacitor. For instance, in the pixel $P_{11}$, the first sub-pixel $SP_{11A}$ comprises a liquid crystal capacitor $C_{LC}$ and a storage capacitor $C_{ST}$. The capacitors $C_{LC}$ and $C_{ST}$ are connected in parallel with each other between the first end 1 of the pixel switch $SW_{11A}$ and a common end $V_{COM}$. The common end $V_{COM}$ is utilized for providing a common voltage $V_{COM}$. The second sub-pixel $SP_{11B}$ comprises a liquid crystal capacitor $C_{LC}$ and a storage capacitor $C_{ST}$. The capacitors $C_{LC}$ and $C_{ST}$ are connected in parallel between the second end 2 of the pixel switch $SW_{11C}$ and the common end $V_{COM}$. The structures of the rest pixels are similar to the pixel $P_{11}$ and hereinafter will not be repeated again for brevity.

In conclusion, by means of the pixel array (pixel circuit) provided by the present invention, the different data are effectively transmitted to the different sub-pixels of a pixel so that the different sub-pixels of the pixel have the luminance with different gray level so as to reduce the color washout phenomenon, causing a great convenience.

Those skilled in the art will readily observe that numerous modifications and alterations of the device and method may be made while retaining the teachings of the invention.

What is claimed is:

1. A pixel circuit, comprising:
a first scan line;
a second scan line,
a data line;
a first pixel switch, comprising:
a first end, coupled to the data line;
a second end; and
a control end, coupled to the second scan line;
a second pixel switch, comprising:
a first end, coupled to the second end of the first pixel switch;
a second end; and
a control end, coupled to the first scan line;
a third pixel switch, comprising:
a first end, coupled to the data line;
a second end; and
a control end, coupled to the first scan line; and
a pixel, comprising:
a first sub-pixel, coupled to the second end of the second pixel switch for coupling to the data line through the first pixel switch and the second pixel switch; and
a second sub-pixel, coupled to the second end of the third pixel switch for coupling to the data line through the third pixel switch;
wherein the first sub-pixel and the second sub-pixel are on a same side of the data line;
wherein a driving method for the pixel circuit comprises:
at a first moment, driving the first scan line for turning on the second pixel switch and the third pixel switch for a first predetermined period;
at the first moment, driving the second scan line for turning on the first pixel switch for a second predetermined period;
wherein the second predetermined period is shorter than the first predetermined period;
wherein the difference between the first predetermined period and the second predetermined period is a third predetermined period;
during the second predetermined period, providing a first data to the first and the second sub-pixels through the first pixel switch and the third pixel switch, respectively; and
during the third predetermined period, providing a second data to the second sub-pixel through the third pixel switch.

2. The pixel circuit of claim 1, wherein:
the first sub-pixel comprises:
a liquid crystal capacitor, coupled between the second end of the second pixel switch and a common end; and
a storage capacitor, coupled between the second end of the second pixel switch and the common end; and
the second sub-pixel comprises:
a liquid crystal capacitor, coupled between the second end of the third pixel switch and the common end; and
a storage capacitor, coupled between the second end of the third pixel switch and the common end.

3. The pixel circuit of claim 1, wherein when a first scan signal of the first scan line controls the second pixel switch to turn on and a second scan signal of the second scan line controls the first pixel switch to turn on, the first sub-pixel receives a signal from the data line.

4. The pixel circuit of claim 1, wherein when a first scan signal of the first scan line controls the third pixel switch to turn on, the second sub-pixel receives a signal from the data line.

5. The pixel circuit of claim 1, wherein:
the first sub-pixel comprises:
a liquid crystal capacitor, coupled between the second end of the second pixel switch and a common end; and
a storage capacitor, coupled between the second end of the second pixel switch and the common end; and
the second sub-pixel comprises:
a liquid crystal capacitor, coupled between the second end of the third pixel switch and the common end; and
a storage capacitor, coupled between the second end of the third pixel switch and the common end.

6. The pixel circuit of claim 1, wherein when a first scan signal of the first scan line controls the second pixel switch to turn on and a second scan signal of the second scan line controls the first pixel switch to turn on, the first sub-pixel receives a signal from the data line.

7. The pixel circuit of claim 1, wherein when a first scan signal of the first scan line controls the third pixel switch to turn on, the second sub-pixel receives a signal from the data line.

8. A pixel circuit, comprising:
a first scan line;
a second scan line,
a data line;
a first pixel switch, comprising:
a first end, coupled to the data line;
a second end; and
a control end, coupled to the second scan line;
a second pixel switch, comprising:
a first end, coupled to the second end of the first pixel switch;
a second end; and
a control end, coupled to the first scan line;
a third pixel switch, comprising:
a first end, coupled to the data line;
a second end; and
a control end, coupled to the first scan line; and
a monochromatic pixel, comprising:
a first sub-pixel, coupled to the second end of the second pixel switch for coupling to the data line through the first pixel switch and the second pixel switch; and
a second sub-pixel, coupled to the second end of the third pixel switch for coupling to the data line through the third pixel switch;
wherein the first sub-pixel and the second sub-pixel are on a same side of the data line;
wherein a driving method for the pixel circuit comprises:
at a first moment, driving the first scan line for turning on the second pixel switch and the third pixel switch for a first predetermined period;
at the first moment, driving the second scan line for turning on the first pixel switch for a second predetermined period;

wherein the second predetermined period is shorter than the first predetermined period;

wherein the difference between the first predetermined period and the second predetermined period is a third predetermined period;

during the second predetermined period, providing a first data to the first and the second sub-pixels through the first pixel switch and the third pixel switch, respectively; and during the third predetermined period, providing a second data to the second sub-pixel through the third pixel switch.

* * * * *